US006886625B1

(12) United States Patent
Sagal et al.

(10) Patent No.: US 6,886,625 B1
(45) Date of Patent: May 3, 2005

(54) ELASTOMERIC HEAT SINK WITH A PRESSURE SENSITIVE ADHESIVE BACKING

(75) Inventors: E. Mikhail Sagal, Narragansett, RI (US); Jeffrey Panek, North Kingstown, RI (US); Kevin A. McCullough, North Kingstown, RI (US)

(73) Assignee: Cool Options, Inc., Warwick, RI (US)

( * ) Notice: Subject to any disclaimer, the term of this patent is extended or adjusted under 35 U.S.C. 154(b) by 116 days.

(21) Appl. No.: 10/222,574

(22) Filed: Aug. 16, 2002

Related U.S. Application Data

(60) Provisional application No. 60/314,892, filed on Aug. 24, 2001, provisional application No. 60/314,433, filed on Aug. 23, 2001.

(51) Int. Cl.[7] ..... H05K 7/20

(52) U.S. Cl. ..... 165/46; 165/80.3; 165/185; 361/704

(58) Field of Search ..... 165/46, 80.3, 185; 361/704, 710

(56) References Cited

U.S. PATENT DOCUMENTS

| | | | | |
|---|---|---|---|---|
| 4,900,877 | A | 2/1990 | Dubrow et al. | |
| 4,938,279 | A | 7/1990 | Betker | |
| 4,948,922 | A | 8/1990 | Varadan et al. | |
| 4,999,741 | A | 3/1991 | Tyler | |
| 5,061,566 | A | 10/1991 | Morgan | |
| 5,115,104 | A | 5/1992 | Bunyan | |
| 5,187,225 | A | 2/1993 | Kitagawa | |
| 5,315,480 | A | 5/1994 | Samarov et al. | |
| 5,430,609 | A | 7/1995 | Kikinis | |
| 5,440,172 | A | 8/1995 | Sutrina | |
| 5,513,070 | A | 4/1996 | Xie et al. | |
| 5,552,960 | A | 9/1996 | Nelson et al. | |
| 5,557,500 | A | 9/1996 | Baucom et al. | |
| 5,572,070 | A | 11/1996 | Ross | |
| 5,653,280 | A * | 8/1997 | Porter | 165/80.3 |
| 5,660,917 | A | 8/1997 | Fujimori et al. | |
| 5,738,936 | A | 4/1998 | Hanrahan | |
| 5,745,344 | A * | 4/1998 | Baska et al. | 361/705 |
| 5,781,412 | A | 7/1998 | de Sorgo | |
| 5,790,376 | A | 8/1998 | Moore | |
| 5,910,524 | A | 6/1999 | Kalinoski | |
| 6,093,961 | A * | 7/2000 | McCullough | 257/718 |

(Continued)

FOREIGN PATENT DOCUMENTS

JP 11335562 A * 12/1999

*Primary Examiner*—Allen J. Flanigan
(74) *Attorney, Agent, or Firm*—Barlow, Josephs & Holmes, Ltd.

(57) ABSTRACT

The present invention discloses a net-shape molded elastomeric heat-dissipating device that includes an integrally formed conformable interface surface. A base elastomeric matrix material is loaded with thermally conductive filler and injected into a mold cavity to form the completed device. Further, a layer of thermally conductive pressure sensitive adhesive material is applied to the conformable interface surface to allow the device to be securely fastened to a heat-generating surface. The present invention provides superior sealing and elimination of voids and air gaps that are typically found between the thermal transfer surfaces thereby facilitating enhanced thermal transfer properties. In addition, the present invention provides a method of manufacturing an elastomeric heat sink device as described above.

6 Claims, 3 Drawing Sheets

U.S. PATENT DOCUMENTS 6,204,303 B1 3/2001 Osuna et al.
6,348,654 B1 2/2002 Zhang et al.
6,385,047 B1 * 5/2002 McCullough et al. ..... 361/704
6,410,137 B1 6/2002 Bunyan
6,680,015 B2 * 1/2004 McCullough ..... 264/105
2002/0195232 A1 * 12/2002 Katsui ..... 165/104.33

* cited by examiner

ELASTOMERIC HEAT SINK WITH A PRESSURE SENSITIVE ADHESIVE BACKING

CROSS-REFERENCE TO RELATED APPLICATIONS

This application is related to and claims priority from earlier filed provisional patent application Nos. 60/314,433 filed Aug. 23, 2001 and 60/314,892 filed Aug. 24, 2001.

BACKGROUND OF THE INVENTION

The present invention relates generally to an elastomeric material composition for use in connection with heat generating electronic devices and a method for manufacturing the same. More particularly, this invention relates to a new net-shape molded thermally conductive elastomeric polymer heat sink device having an integral interface and fastening means. The composition contains thermally conductive filler material in a conformable elastomeric matrix and an integral means for adhering the device to a heat-generating surface to forming an improved heat sink device with an integral, conformable thermally conductive interface layer. Further, a method of manufacturing the device is also provided.

In the prior art, it is well known that the most critical locations that effect the overall performance of a heat transfer assembly are the interface points. These locations are where two different materials mate to one another introducing two contact surfaces and often an air gap across which the heat being dissipated must be transferred. Generally, the contact surfaces are not always perfectly flat due to milling or manufacturing tolerances thus creating gaps between the heat generating surface and the heat dissipating devices thereby increasing the overall thermal resistance of the assembly. These imperfections and gaps between the mating surfaces often contain small pockets of air and thus reduce the heat transfer potential across the interface between the heat generating surface and the heat-dissipating device.

Various materials have been employed in the prior art in an attempt to bridge this interface gap. In particular, organic base materials such as polysiloxane oils or polysiloxane elastomeric rubbers and thermoplastic materials such as PVC, polypropylene, etc. loaded with thermally conducting ceramics or other fillers such as aluminum nitride, boron nitride or zinc oxide have been used to impart thermally conducting properties to the organic base material. In the case of polysiloxane oils loaded with thermally conducting materials, these materials are applied by smearing the heat sink or other electronic component with the thermally conducting paste and then securing the heat sink in place by mechanical means using clips or screws. While the prior art, thermal greases show superior film forming and gap filling characteristics between uneven surfaces thus providing an intimate contact between the surface of the heat sink and the surface of the heat-generating source. However, it has been found that the use of thermal greases exhibit poor adhesions to the surfaces of the heat sink and heat generating surface, thus effectively seeping out from between the heat sink and the heat generating surface, causing air voids to form between the two surfaces leading to hot spots. Moreover, excessive pressure placed upon the heat sink by the mechanical fasteners accelerates this seepage from between the heat sink and the surface of the heat-generating surface. It has been reported that excessive squeeze out of polysiloxane oils can evaporate and recondense on sensitive parts of the surrounding microcircuits. The recondensed oils lead to the formation of silicates thereby interfering with the function of the microprocessor and eventually causing failure.

In the case of polysiloxane rubbers and thermoplastic polymers, these materials are typically cast in sheet form and die cut into shapes corresponding to the shape of the heat sink and heat generating device. The resulting preformed sheet is then applied to the surface of the heat-generating surface securing the heat sink by means of clips or screws. The precut films solve the problems associated with greases but do not provide adequate intimate contact required for optimum heat transference between the heat generating source and the heat sink. The added step of cutting preforms and manually applying the pad adds cost to the assembly process. Furthermore, these types of materials show variable performance due to variation in the thickness of the pad and the amount of pressure applied to the thermally conducting precut film, based upon the mechanical device or action used to secure the heat sink. Further, while these known interface materials, are suitable for filling undesirable air gaps, they are generally are less thermally conductive than the heat sink member thus detracting from the overall thermal conductivity of the assembly.

An additional drawback to most of the above noted interface materials is that they require a machined heat sink be secured to a heat generating surface or device using mechanical clips or screws adding to the complexity and assembly time for the overall assembly.

In an attempt to overcome the requirement of mechanical fastening some prior art thermal interface pads are formed of a material that is soft and pliable, having an adhesive on both sides. The pad is first applied under pressure to the mating surface of the heat-dissipating device and the assembly is then pressed onto the heat-generating surface. The pliability of the interface material allows the pad to be compressed into the small grooves and imperfections on the two mating surfaces thus improving the overall performance of the heat transfer through the interface area. The drawback in the prior art is that the use of an adhesive interface pad requires an additional fabrication/assembly step and introduces an additional layer of material along the heat dissipation pathway. Further, as mentioned above, since all of the materials within the assembly are different, optimum heat transfer cannot be achieved.

Therefore, in view of the foregoing, heat transfer assemblies that are formed of a monolithic material having an integral interface contact surface that includes a means for mounting the assembly to a heat-generating surface are highly desired. There is also a demand for a heat dissipating assembly for use in an electronic device that is lightweight, has an integral interface surface and is net-shape moldable from a thermally conductive material so that complex geometries for accurate mating of the case surfaces can be achieved.

SUMMARY OF THE INVENTION

The present invention is generally directed to a highly thermally conductive elastomeric heat-dissipating device that is net shape molded and includes an adhesive on the interface surface thereof. The elastomeric device of the present invention enables complex shapes to be injection molded cost-effectively while providing passive cooling and an improved thermal interface having a reduced thermal resistivity as compared to analogous devices in the prior art. The thermally conductive elastomer is molded into an engineered shape having surface area enhancements and is employed for dissipating heat from a heat-generating source, such as a semiconductor device. Further, the device of the present invention includes an integrally molded conformable thermal interface surface. The thermal composite material is preferably an elastomeric polymer base loaded with thermally conductive filler material. The molded shape may be of any type suited for efficient transfer and dissipation of heat. In addition, the device may be insert molded to include arrays of pins or fins, other heat dissipation geometries or to incorporate heat tubes for increased heat transfer.

An elastomeric base polymer is included in the present invention in order to allow the heat dissipation element to have a resilient and flexible structure that provides a base or interface that can be conformed to intimately contact the heat-generating surface. As can be seen, using an elastomer having a relatively high modulus of elasticity allows the base material to bridge and fill the gaps present in the prior art without requiring an additional interface pad.

Further, the present invention provides for a layer of pressure sensitive adhesive to be applied on the contact surface where it meets the heat-generating surface. This adhesive may be of the release type where a layer of release paper is removed to expose the adhesive for use. In general, the use of an adhesive on the elastomeric material facilitates use of the material and obviates the need for separate clamps or clips. In addition, final assembly is simplified by eliminating an element and a required assembly step. Also, the adhesive is preferably thermally conductive in nature. In this configuration, the present can be firmly mounted to the heat-generating device to effectively provide continuous contact and hold the conformable elastomeric material in conformance to the surface of the heat-generating surface to eliminate the air gaps found in the prior art.

Various adhesive materials are known in the prior art that can be applied either during manufacture or at the time of assembly to adhere the heat dissipating assembly of the present invention to the heat-generating surface. Alternately, the adhesive material may be incorporated into a matrix of the base elastomeric material and molded over the base interface surface of the present device to provide an integral adhesive bonding material while maintaining the continuity of the thermal transfer properties of the present invention.

It is therefore an object of the present invention to provide an elastomeric heat sink for use in an electronic device that enhances the dissipation of heat from a heat generating electronic component upon which the device is mounted.

It is also an object of the present invention to provide an elastomeric heat sink for use in an electronic device that has an integrally formed conformable thermal interface surface that directly provides heat dissipation for a heat generating electronic component upon which the device is mounted.

It is a further object of the present invention to provide an elastomeric heat sink having an integrally formed conformable thermal interface surface that includes a means for adhesively fastening the device to a heat generating surface, eliminating the need for additional fastening means.

It is yet another object of the present invention to provide a heat sink as described above that passively provides heat transfer between the heat generating surface and the heat sink while having an integrally formed conformable interface that fills any gaps or voids therebetween.

It is a further object of the present invention to provide an elastomeric heat sink having an integrally formed conformable interface surface for an electronic device that is injection moldable from a thermal composite material into complex geometries to accommodate a variety of device case shapes.

Other objects, features and advantages of the invention shall become apparent as the description thereof proceeds when considered in connection with the accompanying illustrative drawings.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE INVENTION

Figure 1:
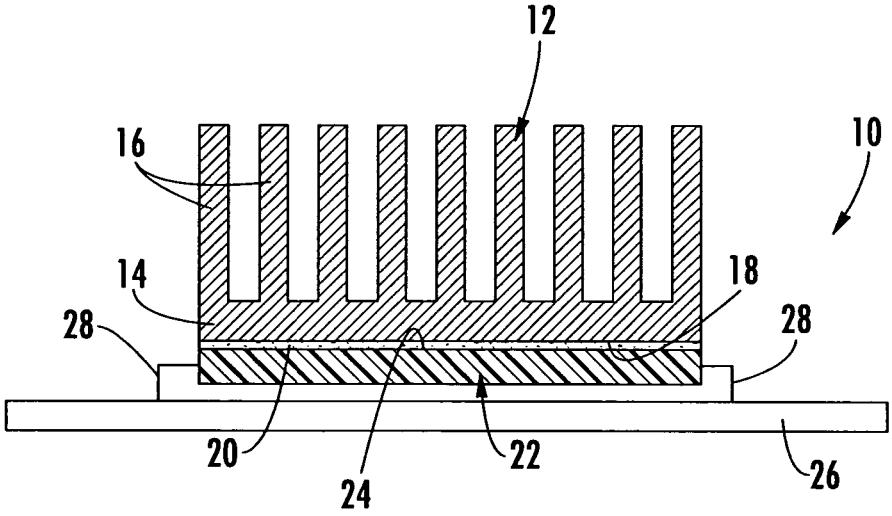
FIG. 1 is a cross-sectional view of the heat dissipation assembly of the present invention.

Referring now to the drawings, the heat dissipation assembly of the present invention is shown and illustrated generally as 10. The present invention is a heat dissipation assembly 10 and a method by which that assembly, formed by combining an elastomeric polymer base matrix and a thermally conductive filler, is molded into a finished component for final installation onto a heat generating electronic device.

The assembly 10 of the present invention is shown here, by way of example, as a heat sink device 12 having a base element 14, integrally formed surface area enhancements 16 and an interface surface 18 to which an adhesive layer 20 is applied. The heat sink device 12 is applied to a heat generating electronic device 22 that has a heat generating surface 24 and is typically installed onto an electronic circuit board 26 via wire leads 28. While specific structure is used here to illustrate the present invention, it would be understood by one skilled in the relevant art that the disclosure provided herein could be modified to provide any geometry or be applied in any application where heat must be dissipated from a heat-generating device.

Figure 2:
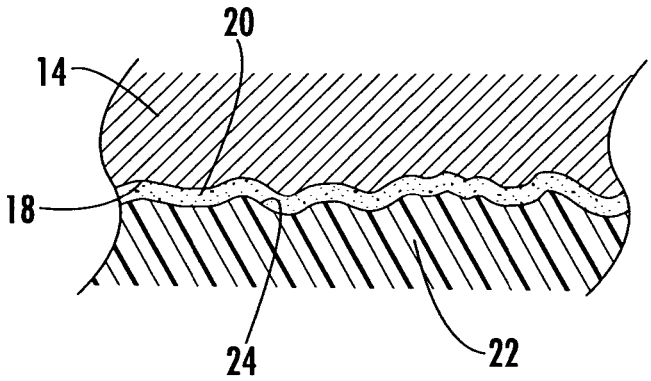
FIG. 2 is a magnified view of the interface portion of the heat dissipation assembly of FIG. 1.

Turning now to FIGS. 1 and 2 the preferred embodiment of the heat dissipating assembly 10 is shown. Specifically, the heat dissipating assembly 10 is shown to include a heat sink 12 that is formed from a thermally conductive material such as an elastomeric base polymer matrix. Further, the heat sink 12 includes a base member 14 and integrally formed fins 16 that are integrally formed with and protrude upwardly from the base member 14. This geometry allows heat to be transferred efficiently through the base member 14 for dissipation through the increased surface area found in the fins 16. The base member further includes an interface surface 18 opposite the fins 16 for mounting the heat sink 12 in mated relationship to the heat generating surface 24 of a heat generating electronic component 22. In the preferred embodiment, a layer of thermally conductive adhesive material 20 is applied onto the interface surface 18 of the heat sink 12 for facilitating the mounting of the heat sink 12 to the heat-generating surface 24.

The layer of adhesive material 20 is applied to the interface surface 18 of the heat sink 12 at the time of manufacture. This adhesive 20 is preferable of the pressure sensitive type where in the heat sink 12 can be placed onto the heat generating surface 24 during final assembly of the components and repositioned if required before pressure is applied, affixing the heat sink 12 into permanent contact with the heat generating surface 24. If the heat sink 12 will be handled or shipped before it is placed onto the heat-generating surface 24, a layer of removable release paper (not shown) may be provided over the adhesive layer 20 to protect the adhesive 20 from damage or contamination during the intermediate handling or shipping steps. Before final assembly of the heat sink 12 onto the heat-generating surface 24, the release paper is removed, exposing the adhesive layer 20.

As can be best seen in FIG. 2, the use of elastomeric material is an important feature of the present invention. FIG. 2 is a magnified view of the interface between the interface surface 18 of the base element 14 of the heat sink 12 and the heat-generating surface 24 of the electronic device 22. It can be seen that the layer of adhesive material 20 is disposed there between. While the heat generating surface 24 appears to be smooth, in reality, in this magnified view, the heat generating surface 24 can be seen to include many surface imperfections that are the result of milling, polishing or molding of the electronic device 22. In the prior art, a rigid heat sink would be applied over this heat generating surface 24 resulting in numerous small air gaps that would interfere with the efficiency of the heat transfer across the interface. Since the base member 14 of the heat sink 12 in the present invention is formed using an elastomeric polymer, it is conformable. Therefore, when the heat sink 12 is pressed into contact with the heat-generating surface 24, the interface surface 18 on the base element 14 conforms to receive the raised ridges and fills the depressed areas eliminating the voids and air gaps. The layer of pressure sensitive adhesive 20 cooperates with the conformable interface surface 18 to maintain the interface surface 18 in intimate contact with the heat-generating surface 24 and retaining the interface surface 18 in its conformed state. In this manner, the present invention represents an improvement over the prior art by eliminating the air gaps typically found between a heat generating surface and an interface surface of a heat sink, while eliminating the need for providing an additional interface/gap pad.

The heat sink 12 of the present invention is made from a composition that employs a base matrix of elastomeric polymer with different types of thermally conductive filler material loaded therein. The composition is achieved through the steps of combining the base matrix material with a thermally conductive filler material and molding the composition. The base matrix is loaded with thermally conductive filler. The mix may include, for example, by volume, 40 percent base matrix and 60 percent filler material. Depending on the base matrix and filler, loading can be even higher. The filler material is introduced to the base elastomeric polymer matrix. The two components are mixed and loaded into the desired molding machine and associated mold in a fashion known in the art which need not be discussed in detail here. Once removed from the mold, the final composition is in its final shape and ready for its end use. This process, referred to a net shape molding, is known to result in producing polymer compositions with high thermal conductivities as compared to the base matrix alone. Fillers that are suitable for incorporation into the composition used in the present invention include boron nitride, carbon fibers, carbon flakes, carbon powders, metallic grains or flakes and crushed glass. One of the primary reasons for employing a thermally conductive elastomeric composition is that it is moldable into more complex geometries to achieve better heat sink geometries. Because of the versatility of the material, applications that would clearly indicate its use are extremely widespread. Further, because the material is conformable, the need for gap pads and thermal interface pads is eliminated.

Figure 3:
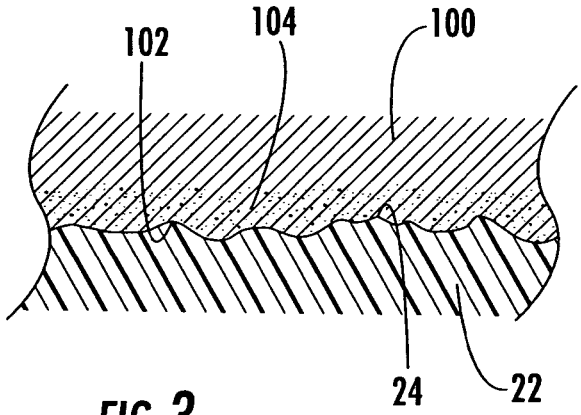
FIG. 3 is a magnified view of the interface portion of an alternate embodiment of the heat dissipation assembly of the present invention.

Turning now to FIG. 3 a magnified view of the interface area between the heat generating surface 24 and an alternate embodiment of a heat sink 100 interface surface 102 is shown. In this configuration, the adhesive material 104 is incorporated within the elastomeric polymer matrix of heat sink 100 near the interface surface 102. The incorporation of the adhesive material 104 is done during the manufacturing process where before injecting the last shot of elastomeric polymer into the mold, the adhesive material is mixed into the molten polymer resulting in the final layer of elastomer injected near the interface surface 102 having integral adhesive properties. In all other aspects, this embodiment of the present invention incorporates all of the features described above.

Figure 4:
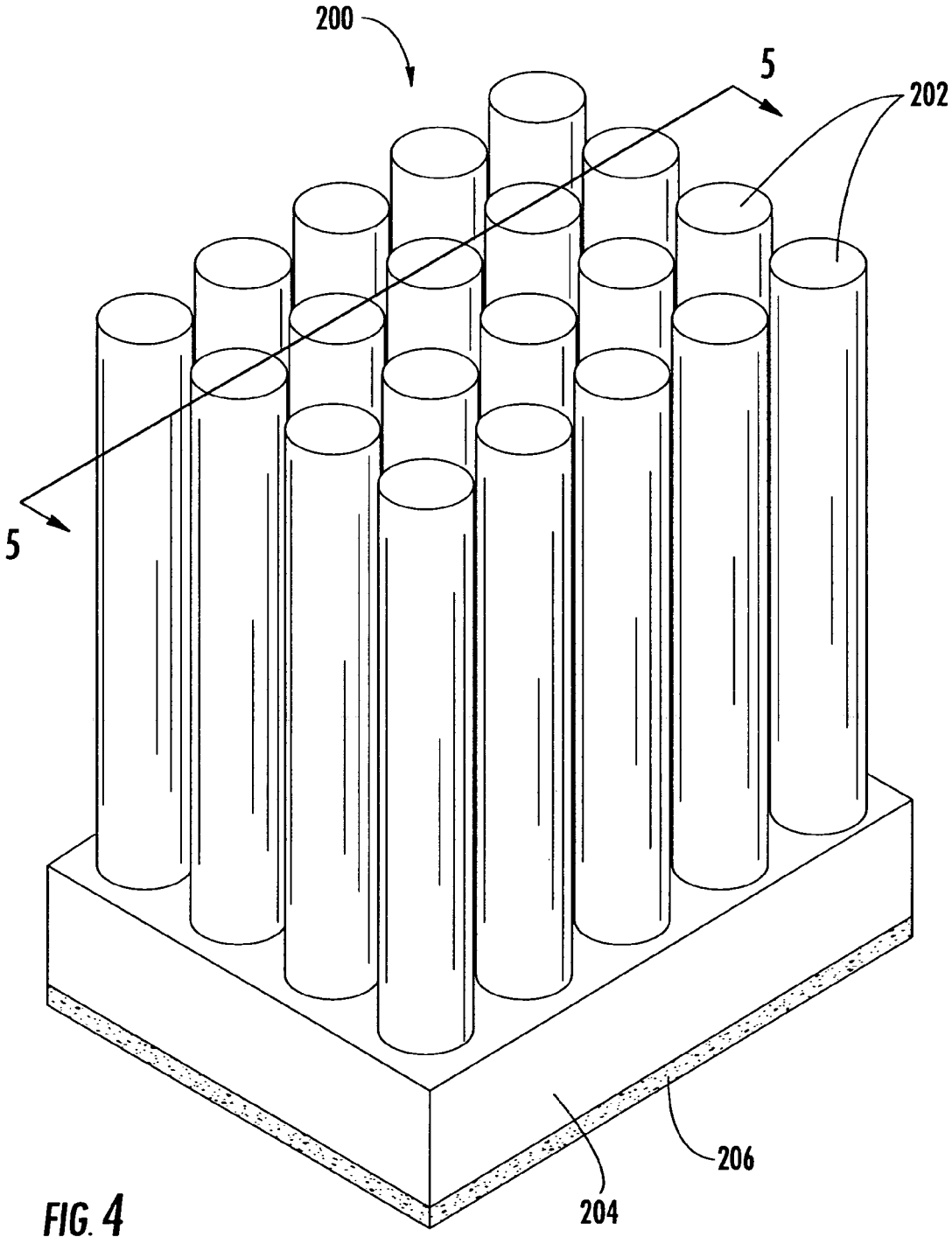
FIG. 4 is a perspective view of a second alternate embodiment of the heat dissipation assembly of the present invention.
Figure 5:
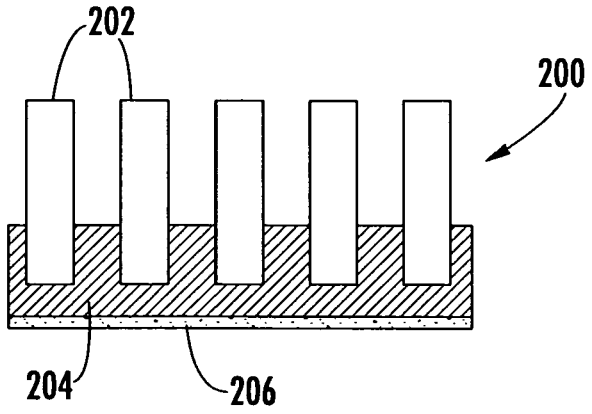
FIG. 5 is a cross-sectional view through the line 5—5 of FIG. 4.
Figure 6:
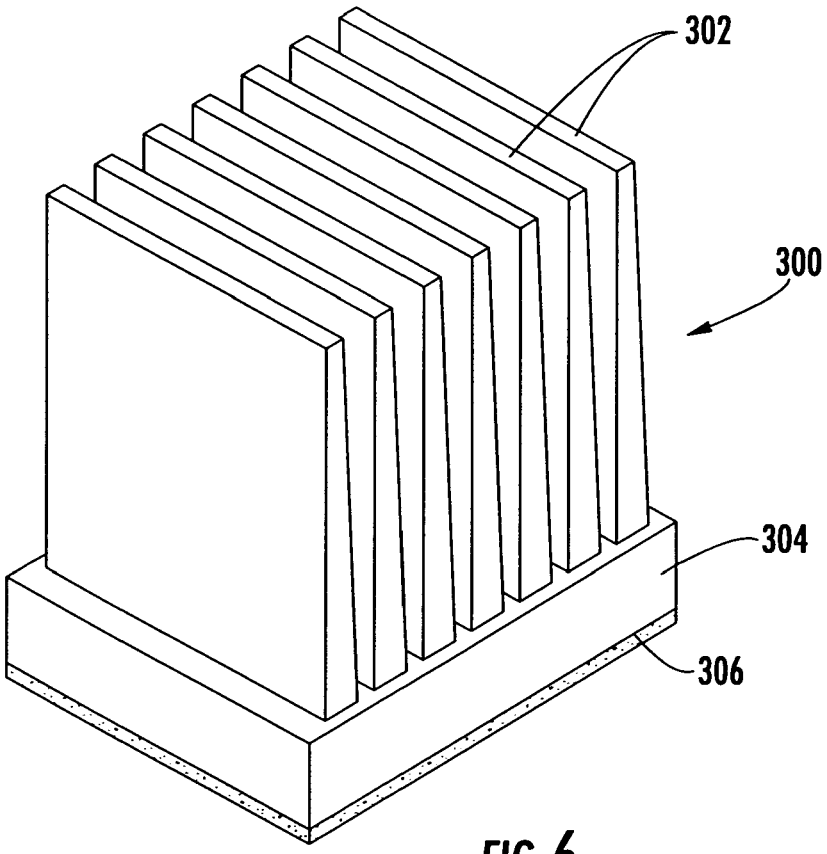
FIG. 6 is perspective view of a third alternate embodiment of the heat dissipation assembly of the present invention.

FIGS. 4, 5 and 6 illustrate alternate embodiments of the heat sink 12 of the present invention. The heat sinks shown in these Figs. are formed using an insert molding process. FIGS. 4 and 5 show a pin type, insert molded heat sink 200 where an array of pins 202 are placed into a mold cavity and the base member 204 is molded around the base of the pins. As can be seen in FIG. 5, the end of the pins 202 are embedded into the base member 204 and retained therein when the molten elastomer cures. As described above adhesive layer 206 is provided on the bottom surface 208 of the heat sink 200. Since the base element 204 is formed from an elastomer, it is conformable in accordance with the description of the preferred embodiment provided above.

Finally, FIG. 6 provides an alternate embodiment heat sink 300 where fins 302 are insert molded into a base element 304 and further includes an adhesive layer 306. Again, since the base element 304 is formed from an elastomer it is conformable in accordance with the description of the preferred embodiment provided above.

In view of the foregoing, a superior moldable heat dissipating assembly that eliminates the requirement of additional gap pads or thermal interfaces can be realized. The conformable base element 14 of the present invention, greatly improves over prior art attempts by integrally providing the heat sink 12 with the ability to bridge and fill the gaps found in typical heat generating surfaces 24. In particular, the present invention provides an integrated thermal interface with a unitary thermal dissipation assembly that is vastly improved over known assemblies and was until now unavailable in the prior art.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A heat dissipating device, comprising:

a flexible base member having a top surface, surface area enhancements adjacent to and integrally molded with said top surface, a deformable bottom surface and a thickness, said base member and said surface area enhancements molded from an elastomeric polymer base matrix and a thermally conductive filler loaded in said polymer base matrix; and an adhesive layer on said bottom surface of said base member.

2. The heat dissipating device of claim 1, wherein said thermally conductive filler is selected from the group consisting of carbon fiber, carbon flakes, carbon powder, boron nitride, metallic flakes and crushed glass.

3. The heat dissipating device of claim 1, wherein said adhesive layer is a pressure sensitive adhesive.

4. A heat dissipating assembly, comprising:

a heat sink, said heat sink having a flexible base member having a top surface, surface area enhancements adjacent to and integrally molded with said top surface, a bottom surface and a thickness, said base member and said surface area enhancements molded from an elastomeric polymer base matrix and a thermally conductive filler loaded in said polymer base matrix and an adhesive layer on said bottom surface of said base member; and a heat generating surface having surface irregularities, said bottom surface of said base member being received on said heat generating surface wherein said bottom surface of said base member conforms to said surface irregularities and is retained in contact with said heat generating surface by said adhesive layer.

5. The heat dissipating assembly of claim 4, wherein said thermally conductive filler is selected from the group consisting of carbon fiber, carbon flakes, carbon powder, boron nitride, metallic flakes and crushed glass.

6. The heat dissipating assembly of claim 4, wherein said adhesive layer is a pressure sensitive adhesive.

* * * * *